US006792786B2

(12) United States Patent
Tanaka

(10) Patent No.: US 6,792,786 B2
(45) Date of Patent: Sep. 21, 2004

(54) FABRICATION METHOD OF METAL SHELL OF SPARK PLUG

(75) Inventor: Kazuhiko Tanaka, Kuwana (JP)

(73) Assignee: Denso Corporation (JP)

( * ) Notice: Subject to any disclaimer, the term of this patent is extended or adjusted under 35 U.S.C. 154(b) by 67 days.

(21) Appl. No.: 10/188,314

(22) Filed: Jul. 3, 2002

(65) Prior Publication Data

US 2003/0005740 A1 Jan. 9, 2003

(30) Foreign Application Priority Data

Jul. 4, 2001 (JP) ..... 2001-203658

(51) Int. Cl.[7] ..... B21D 22/20

(52) U.S. Cl. ..... 72/348; 29/34 R; 29/890.15; 72/347; 72/356; 445/7

(58) Field of Search ..... 72/348, 349, 355.2, 72/347, 352, 356, 358; 29/282, 890.14, 890.144, 890.15, 34 R; 445/7

(56) References Cited

U.S. PATENT DOCUMENTS 3,186,209 A * 6/1965 Friedman
4,352,283 A * 10/1982 Bailey ..... 72/355.2
4,416,141 A * 11/1983 Nippert
4,882,925 A * 11/1989 Ichie et al. ..... 72/356
4,932,251 A * 6/1990 Okada et al.
4,939,829 A * 7/1990 Maki et al.
5,088,311 A * 2/1992 Inoue
6,357,274 B1 * 3/2002 Tanaka et al. ..... 72/356

FOREIGN PATENT DOCUMENTS

| | | | |
|---|---|---|---|
| JP | 56-059555 | * | 5/1981 |
| JP | 57-014440 | * | 1/1982 |
| JP | 58-065541 | * | 4/1983 |
| JP | 01-166847 | * | 6/1989 |
| JP | 04-197544 | * | 7/1992 |
| JP | 7-16693 | | 1/1995 |
| JP | 2001-121240 | * | 5/2001 |

* cited by examiner

*Primary Examiner*—Eric Compton
(74) *Attorney, Agent, or Firm*—Nixon & Vanderhye PC

(57) ABSTRACT

A fabrication method of a metal shell to be installed on a park plug is provided which is made up of a small-diameter portion, a large-diameter portion, and a wrapping portion. The wrapping portion is to be wrapped by staking about the spark plug to achieve installation of the metal shell on the spark plug. The method comprises pressing a workpiece with a punch to shape the wrapping portion of the metal shell in a first cold forging process and processing the workpiece to shape the small-diameter portion of the metal shell in a second cold forging process different from the first cold forging process. This produces the metal shell which is less susceptible to cracks when installed on the spark plug and has an increased service life.

6 Claims, 5 Drawing Sheets

110
111
112
113
114
120
121
122
123
124
130
131a(11)
131b
131c
140
150
152
155
15
160
166

210

111
112
220
113
114

121
122
230
123
124

15
122
240
123
124
131a(11)
131c 15
155
152
150
123
124
131a(11)
131c 15
155
166
160
123
124
131a(11)
131c

FABRICATION METHOD OF METAL SHELL OF SPARK PLUG

BACKGROUND OF THE INVENTION

1. Technical Field of the Invention

The present invention relates generally to an improved fabrication method of a metal shell installed on a spark plug which may be employed in automotive internal combustion engines.

2. Background Art

Typical plug metal shells are installed on spark plugs by staking an annular wrapping end of the metal shell on a porcelain insulator of the spark plug. The wrapping end of the metal shell is usually made by cold forging. The metal shell also has a hollow cylindrical base portion and a hexagonal boss which are also shaped by the cold forging. The hollow cylindrical base portion has threads formed in an exterior surface thereof by rolling.

FIG. 6 illustrates a conventional forging process for fabricating a metal shell of a spark plug, as disclosed in Japanese Patent First Publication No. 7-16693, which forms a wrapping end 11 and a small-diameter base portion 12 of the metal shell in a single process. The formation of the wrapping end 11 is accomplished by striking a large-diameter head portion 13 of a hollow cylindrical workpiece with a cylindrical punch 50 to decrease the diameter of the head portion 13. An outer wall of the small-diameter base portion 12 is shaped by a die 52.

The simultaneous formation of the wrapping end 11 and the small-diameter base portion requires a punch holder 51. It is impossible for the punch holder 51 to have an outer diameter greater than that of the large-diameter head portion of the workpiece. The punch holder 51 must, therefore, be formed to be thin, so that it has a low strength. Forging the workpiece requires exertion of a large pressure on the punch holder 51, which will lead to a problem that cracks or physical deformation of the punch holder 51 arise within a short period of time.

Further, it is difficult to form a large rounded inner wall in an end of the punch holder 51 because it is thin, which results in a drop in fluidity of material of the workpiece around the end of the punch holder 51. This causes a boundary between inner walls of the wrapping end 11 and the large-diameter head portion 13 to be subjected to shrinkage, which may result in formation of cracks near the boundary between the wrapping end 11 and the large-diameter head portion 13.

SUMMARY OF THE INVENTION

It is therefore a principal object of the invention to avoid the disadvantages of the prior art.

It is another object of the invention to provide a fabrication method for fabricating a metal shell which is less susceptible to cracks when installed on a spark plug and has an increased service life.

According to one aspect of the invention, there is provided an improved fabrication method of a metal shell to be installed on a park plug which may be employed in automotive engines. The metal shell has a given length and is made up of a small-diameter portion, a large-diameter portion, and a wrapping portion. The wrapping portion is to be wrapped by staking about a porcelain insulator of a spark plug to achieve installation of the metal shell on the spark plug. The method comprises the steps of: (a) preparing a cylindrical workpiece which has a given length with a first and a second end opposed to each other; (b) preparing a punch and a die; (c) placing the workpiece in the die and pressing the workpiece with the punch from the second end of the workpiece to shape the wrapping portion of the metal shell on a side of the first end of the workpiece in a first cold forging process; and (d) processing the workpiece to shape the small-diameter portion of the metal shell on a side of the second end of the workpiece in a second cold forging process.

In the preferred mode of the invention, the method further comprises the step of forming threads on an outer peripheral wall of the small-diameter portion for installation of the spark plug.

The method further comprises the step of processing the workpiece to form a large-diameter portion on the side of the second end and a small-diameter portion on the side of the first end prior to the first cold forging process in which the wrapping portion is formed.

In the first cold forging process, a portion of the workpiece on the side of the first end is pressed within the die stepwise to decrease, in sequence, the portion of the workpiece in outer diameter to shape the wrapping portion of the metal shell.

A hexagonal boss may be formed on the large-diameter portion of the workpiece in the first cold forging process.

The hexagonal boss may alternatively be formed on the large-diameter portion of the workpiece in a third process different from the first and second cold forging process.

BRIEF DESCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings.

DESCRIPTION OF THE PREFERRED EMBODIMENTS

Figure 1:
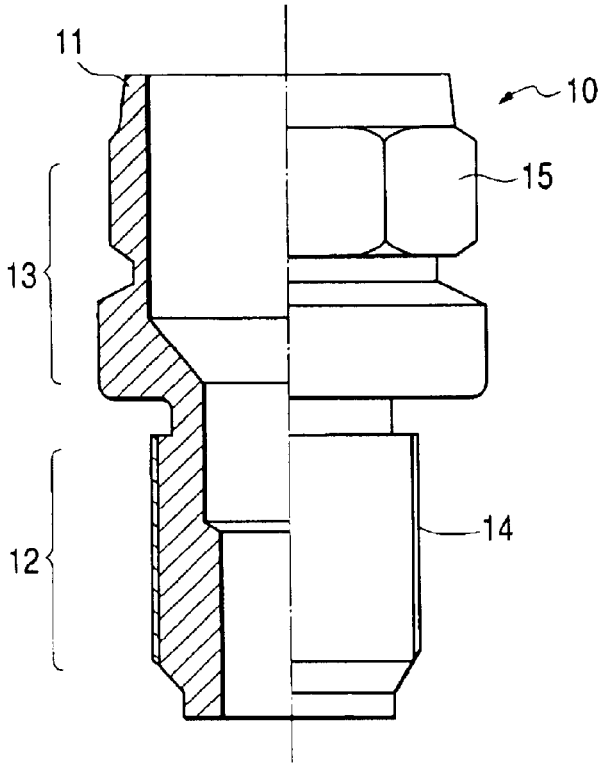
FIG. 1 is a partially sectional view which shows a metal shell fabricated by cold forging according to the invention.

Referring to the drawings, wherein like reference numbers refer to like parts in several views, particularly to FIG. 1 there is shown a metal shell 10 to be installed on a spark plug 1 for use in, for example, automotive internal combustion engines which is made by a method of the first embodiment of the invention.

The metal shell 10 is form by a hollow cylindrical member made of a conductive metal such as a low carbon steel. The metal shell 10 consists essentially of a wrapping end 11, a small-diameter base portion 12, and a large-diameter head portion 13 formed between the wrapping end 11 and the small-diameter base portion 12. The small-diameter base portion 12 has formed on an exterior surface thereof threads 14 which mesh with a threaded hole formed in a cylinder head of the engine (not shown). The large-diameter head portion 13 has formed on an outer wall thereof a generally hexagonal boss 15 used for grasping and turning thereof using a suitable tool such as a conventional spark plug socket.

Figure 2:
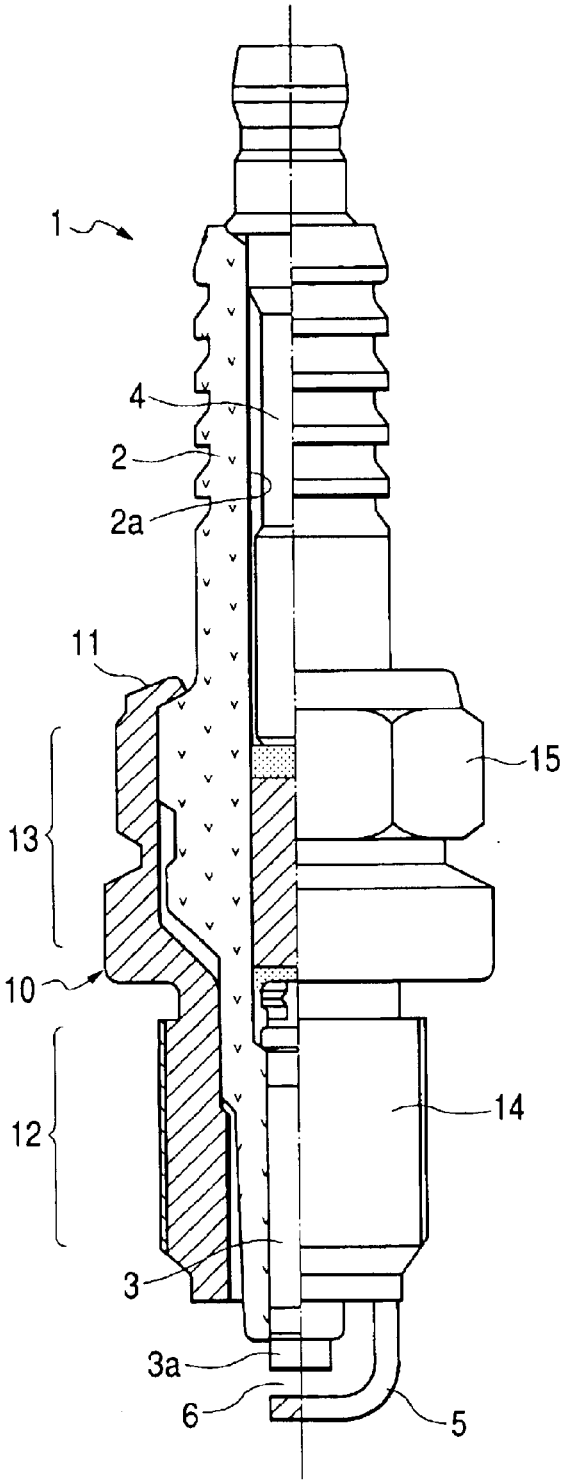
FIG. 2 is a partially longitudinal view which shows a spark plug equipped with the metal shell of FIG. 1.

FIG. 2 shows a spark plug 1 on which the metal shell 10 of FIG. 1 is installed. The spark plug 1 includes a hollow cylindrical porcelain insulator 2 made of an alumina ceramic ($Al_2O_3$). The porcelain insulator 2 is partially retained within the metal shell 10 and has opposed ends exposed out of the metal shell 10. The retaining of the porcelain insulator 2 in the metal shell 10 is accomplished by inserting the porcelain insulator 2 into the metal shell 10 and elastically bending or staking the wrapping end 11 inward.

The spark plug 1 also includes a cylindrical center electrode 3, a stem 4, and a ground electrode 5. The center electrode 4 and the stem 4 are disposed within a longitudinal chamber 2*a* of the porcelain insulator 2. The center electrode 4 has a tip 3*a* exposed outside the porcelain insulator 2 and a rear end thereof joined electrically to the stem 4. The ground electrode 5 is welded to an end of the metal shell 10. The ground electrode 5 is bent to an L-shape to define an air gap 6 (also called a spark gap) between a tip thereof and the tip 3*a* of the center electrode 3.

A cold forging fabrication method of the metal shell 10 will be described below with reference to FIGS. 3(*a*) to 4.

First Process

Figures 3A, 3B, 3C, 3D, 3E, 3F:
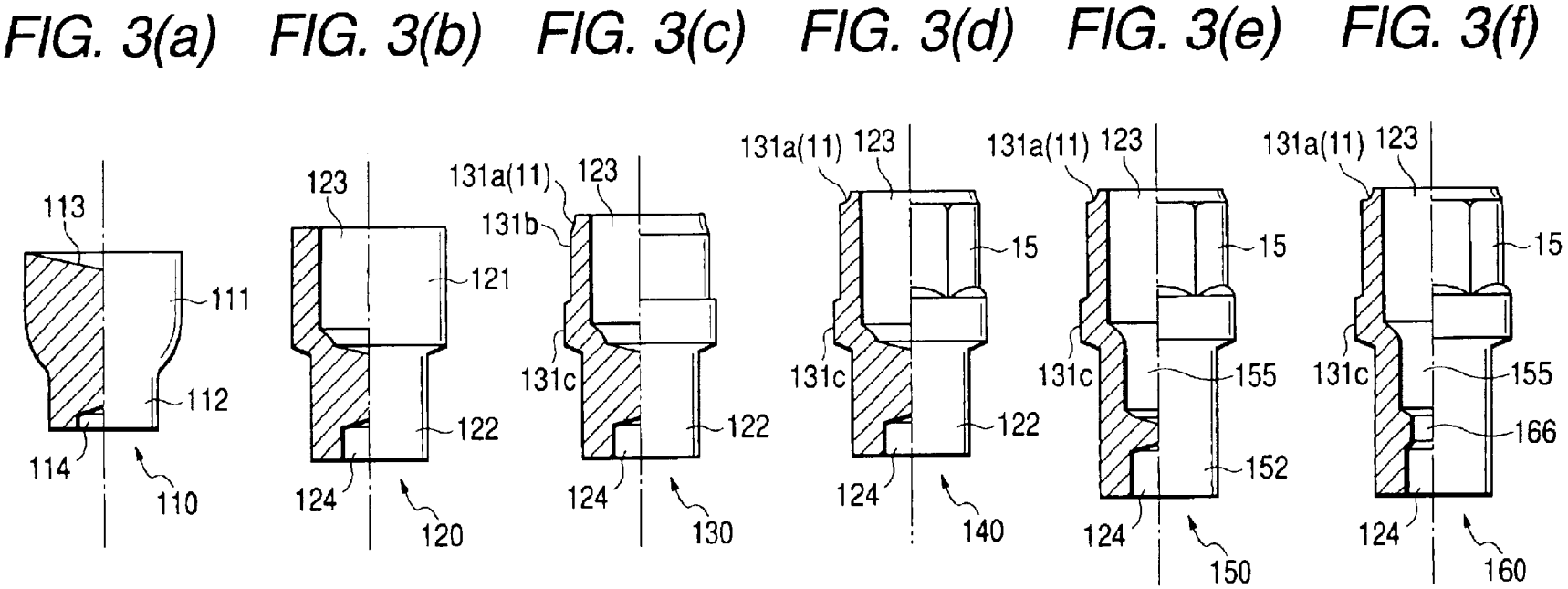
FIGS. 3(*a*), 3(*b*), 3(*c*), 3(*d*), 3(*e*), and 3(*f*) illustrate a sequence of cold forging process for making the metal shell of FIG. 1 according to the first embodiment of the invention.

First, a metal cylinder which is made of, for example, a low carbon steel and cut to a given length is placed in a first station (i.e., a die cavity) of a cold forging machine (not shown) and swaged to form a first forged cylindrical workpiece 110, as shown in FIG. 3(*a*), with a sloping shoulder. The forged cylindrical workpiece 110 is made up of a head portion 111 and a base portion 112 smaller in diameter than the head portion 111. The forged cylindrical workpiece 110 also has a large-diameter bore 113 and a small-diameter bore 114 formed on opposed ends thereof.

Second Process

The forged cylindrical workpiece 110 is placed in a second station (not shown) of the cold forging machine and subjected to extrusion molding to form a second forged workpiece 120, as shown in FIG. 3(*b*). The second forged workpiece 120 has a substantially horizontal shoulder to define a large cylindrical head preform 121 and a small cylindrical base preform 122. The large cylindrical head preform 121 has formed in an end thereof a bore 123 deeper than the bore 113 of the first forged cylindrical workpiece 110. Similarly, the small cylindrical base preform 122 has formed in an end thereof a bore 124 which is deeper than the bore 114 of the first forged cylindrical workpiece 110 and smaller in diameter than the bore 123.

Third Process

The second forged workpiece 120 is placed in a third station (not shown) of the cold forging machine and subjected to extrusion molding to form a third forged workpiece 130, as shown in FIG. 3(*c*). In the third process, only the large cylindrical head preform 121 is extrusion molded. Specifically, the outer wall of the large cylindrical head preform 121 is machined to form three parts: a tapered wall 131*a*, a cylindrical wall 131*b*, and an annular projecting wall 131*c*. The tapered wall 131*a* forms the wrapping end 11 of the metal shell 10 and is smallest in outer diameter of the three. The annular projecting wall 131*c* is greatest in outer diameter of the three.

Figure 4:
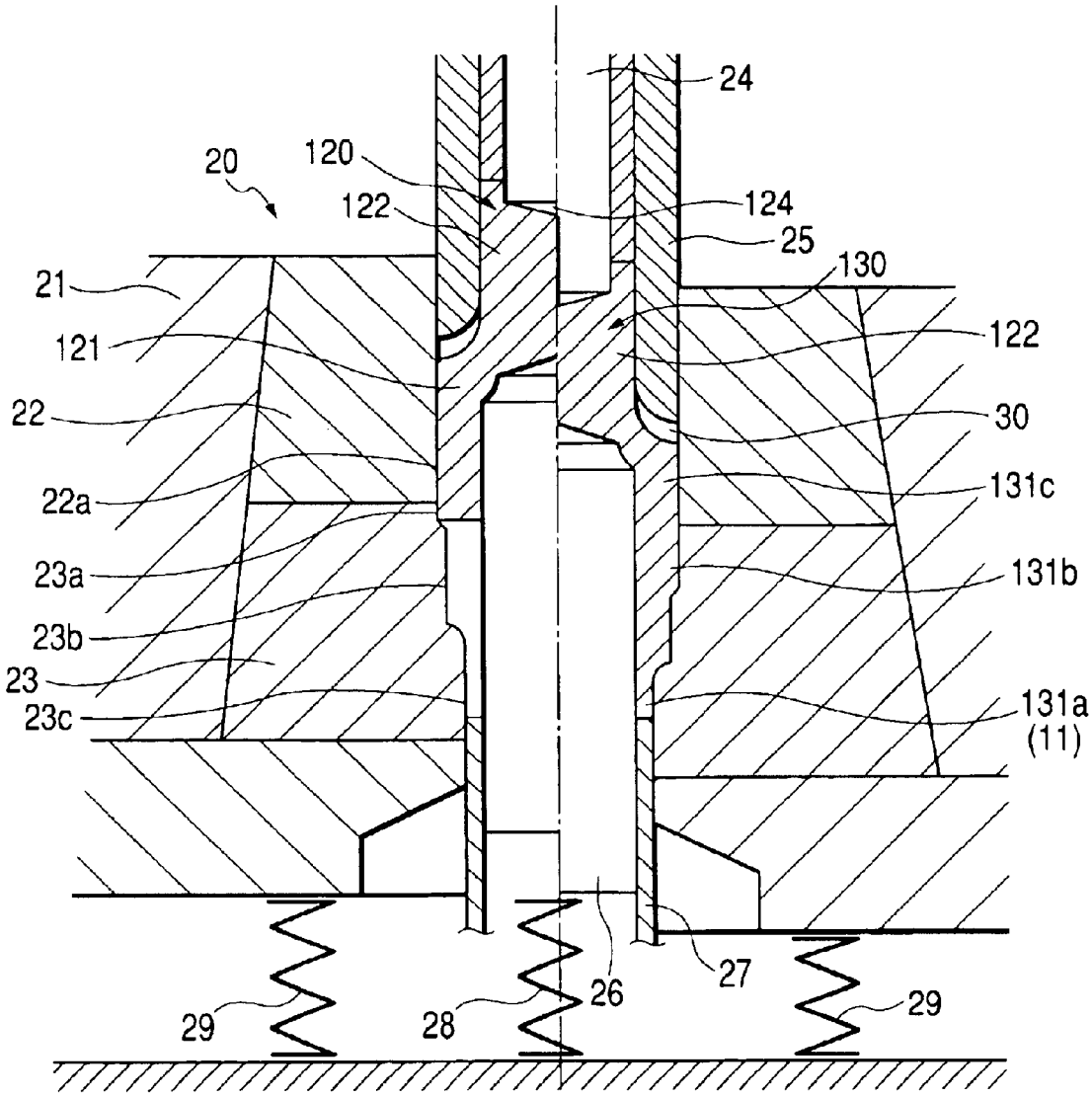
FIG. 4 is a partially sectional view which shows a cold forging machine used in the third process in FIG. 3(*c*)

FIG. 4 shows an internal structure of the third station of the cold forging machine at which the third forged workpiece 130 is made in the third process, as described above. A left half of the drawing illustrates the second forged workpiece 120 before machined in the third process. A right half illustrates the third forged workpiece 130 after machined in the third process.

Employed in the third process is an extrusion molding machine 20 which includes an upper die 22 and a lower die 23 disposed in a die holder 21. The upper die 22 has formed therein a cylindrical bore 22*a* which is substantially equivalent in diameter and shape to the large cylindrical head preform 121. The lower die 23 has three cylindrical bores 23*a*, 23*b*, and 23*c* formed coaxially with the cylindrical bore 22*a* of the upper die 22. The first bore 23*a* leads directly to the bore 22*a* of the upper die 22 and has the same diameter (e.g., ϕ19) as that of the bore 22*a*. The second bore 23*b* formed beneath the first bore 23*a* has an inner diameter (e.g., ϕ18) that is smaller than that of the first bore 23*a*. The third bore 23*c* formed beneath the second bore 23*b* has an inner diameter (e.g., ϕ16) that is smaller than that of the second bore 23*b*.

Formed between the first and second bores 23*a* and 23*b* is a rounded wall having a radius R of, for example, 1 mm. Similarly, formed between the second and third bores 23*b* and 23*c* is a rounded wall having a radius R of, for example, 2 to 2.5 mm. Each of the upper and lower dies 22 and 23 is made of, for example, cemented carbide. The bore 22*a* of the upper die 22 and the first to third bores 23*a* to 23*c* of the lower die 23 are coated with, for example, titanium nitride using CVD coating techniques.

The extrusion molding machine 20 also includes a punch 24, a sleeve 25, and mandrel 26. The punch 24 has an outer diameter substantially identical with the inner diameter of the bore 124 of the second forged workpiece 120 and is held to be slidable in a vertical direction, as viewed in the drawing, to press the second forged workpiece 120 in direct contact with the bottom of the bore 124 in a longitudinal direction (i.e., a downward direction as viewed in the drawing).

The sleeve 25 is made of a hollow cylindrical member and encompasses the punch 24. The sleeve 25 has an outer diameter substantially identical with the inner diameter of the bore 22*a* of the upper die 22 and an inner diameter substantially identical with the outer diameter of the base preform 122 of the second forged workpiece 120. The sleeve 25 is held to be slidable vertically, as viewed in the drawing, together with the punch 25 and configured so that the tip of the sleeve 25 is located at a given interval away from the shoulder formed between the head preform 121 and the base preform 122 of the second forged workpiece 120 when the punch 24 is at the tip thereof in direct contact with the bottom of the bore 124. Specifically, a gap 30 is formed between the tip of the sleeve 25 and the shoulder of the second forged workpiece 120 when the punch 24 abuts to the bottom of the bore 124.

During the third process, the second forged workpiece 120 is held by the mandrel 26 within the upper and lower dies 22 and 23. After completion of the third process, it is removed from the dies 22 and 23 through a kickout sleeve 27. The mandrel 26 is urged upward, as viewed in the drawing, by a coil spring 28 against the downward pressure of the punch 24. Similarly, the upper and lower dies 22 and 23 are urged upward by springs 29.

In operation of the extrusion molding machine 20, the second forged workpiece 120 is first retained by the mandrel 26 within the upper and lower dies 22 and 23. The punch 24 is pressed downward to slide the second forged workpiece 120 within the upper and lower dies 22 and 23. This causes the tip of the head preform 121 of the second forged workpiece 120 to abut on the rounded wall between the first and second bores 23*a* and 23*b* of the lower die 23. A further downward movement of the punch 24 causes the second forged workpiece 120 to be deformed plastically, so that the outer wall of a tip portion of the head preform 121 is shaped by the second bore 23*b* to have a decreased outer diameter substantially identical with the inner diameter of the second bore 23*b*.

A further downward movement of the punch 24 causes the tip of the head preform 121 of the second forged workpiece 120 to abut on the rounded wall between the second and third bores 23*b* and 23*c* of the lower die 23 and be deformed along the inner wall of the third bore 23*c*, so that the outer wall of the tip of the head preform 121 is shaped to have a decreased outer diameter substantially identical with the inner diameter of the third bore 23*c*.

In the manner, as described above, the cylindrical wall 131*b* of the third forged workpiece 131 is finished by the second bore 23*b*, and the tapered wall 131*a* (i.e., the wrapping end 11) is completed by the third bore 23*c*.

If the resistance of the material of the second forged workpiece 120 to deformation thereof when the head preform 121 is decreased in diameter is great, it becomes impossible for the material of the second forged workpiece 120 to have the fluidity required for desired deformation of the head preform 121. The structure of the extrusion molding machine 20 is, however, so designed as to allow the upper and lower dies 22 and 23 to move against the springs 29 for allowing the material of the second forged workpiece 120 to flow when the deformation resistance of the second forged workpiece 120 exceeds a preselected critical value, thereby avoiding the shrinkage.

The tapered wall 131*a* of the third forged workpiece 130 which forms the wrapping end 11 is formed by decreasing the diameter of the tip portion of the head preform 121 of the second forged workpiece 120 a plurality of times (two times in this embodiment) by the second and third bores 23*b* and 23*c*, thus enabling the tapered wall 131*a* to be formed with a relative small resistance to deformation thereof.

The bore 22*a* of the upper die 22 and the first to third bores 23*a* to 23*c* of the lower die 23 are, as described above, coated with, for example, titanium nitride using CVD coating techniques, thus, resulting in a decrease friction between the second forged workpiece 120 and the upper and lower dies 22 and 23, which leads to a decrease in resistance of the material of the second forged workpiece 120 to deformation thereof.

Fourth Process

The third forged workpiece 130 is placed in a fourth station of the cold forging machine and subjected to extrusion molding to form a fourth forged workpiece 140, as shown in FIG. 3(*d*). The cylindrical wall 131*b* of the third forged workpiece 130 is shaped by to form the hexagonal boss 15.

Fifth Process

The fourth forged workpiece 140 is placed in a fifth station (not shown) of the cold forging machine and extrusion molded to form a fifth forged workpiece 150, as shown in FIG. 3(*e*). This process employs a punch tool consisting of larger and smaller punches (not shown). The larger punch has an outer diameter substantially equal to the inner diameter of the bore 123 of the fourth forged workpiece 140. The smaller punch is joined to the tip of the larger punch and has an outer diameter smaller than that of the base preform 122 of the fourth forged workpiece 140.

In the fifth process, only the base portion 12 of the fourth forged workpiece 140 is machined by inserting the punch tool into the bore 123 and pressing the bottom of the bore 123 to extend the base preform 122 in the longitudinal direction thereof, thereby forming a desired length of a base portion 152. The pressing of the punch tool also results in formation a bottom bore 155 in the bottom of the bore 123 which is smaller in diameter than the bore 123.

Sixth Process

The fifth forged workpiece 150 is placed in a sixth station (not shown) of the cold forging machine and punched to form a sixth forged workpiece 160 which has a bore 166 communicating between the bores 155 and 124 of the fifth forged workpiece 150. The peripheral surface and corners of the tapered wall 131*a* and peripheral surfaces of ends of the a base portion 152 are finish machined. The threads 14 are cut in the periphery of the base portion 152 by rolling, thereby forming an end product of the metal shell 10. The ground electrode 5 is, as described above, welded to the metal shell 10. The porcelain insulator 2 and the center electrode 3 are inserted into the metal shell 10, after which the tapered wall 131*a* is bent inward to joint the metal shell 10 to the porcelain insulator 2 firmly, thereby making the spark plug 1.

As apparent from the above discussion, the fabrication method of the metal shell 10 forms the tapered wall 131*a* (i.e., the wrapping end 11) and the base portions 122 and 152 in independent processes, respectively. This allows the peripheral surface of the tapered wall 131*a* to be formed without use of a thin-walled punch as used in a conventional system and also permits the lower die 23 to have an increased thickness, which will result in an increased useful life of the cold forging machine.

The increased thickness of the lower die 23 also allows the great rounded wall to be formed between the first and second bores 23*a* and 23*b* and between the second and third bores 23*b* and 23*c*, thus ensuring desired fluidity of the material of the workpiece 120, which minimizes the undesirable shrinkage thereof to avoid cracks formed in staking the tapered wall 131*a* to join the metal shell 10 to the porcelain insulator 2.

Figures 5A, 5B, 5C, 5D, 5E, 5F:
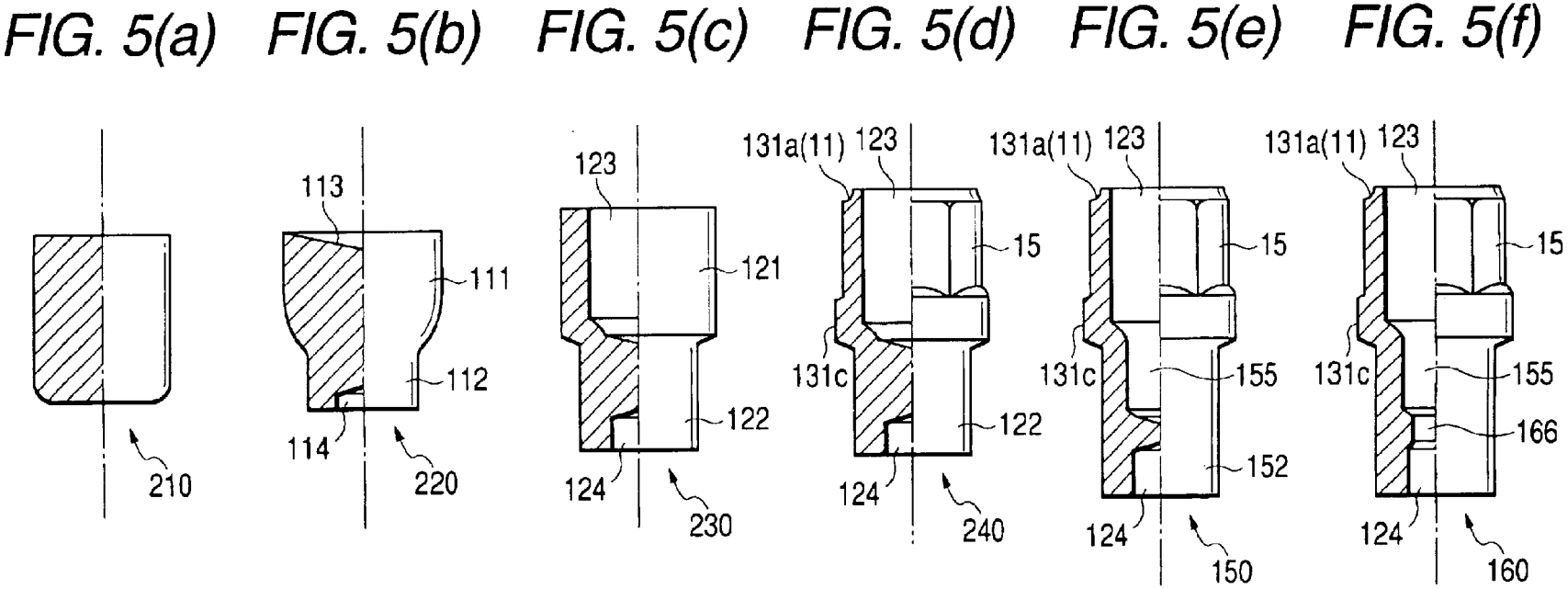
FIGS. 5(*a*), 5(*b*), 5(*c*), 5(*d*), 5(*e*), and 5(*f*) illustrate a sequence of cold forging process for making the metal shell of FIG. 1 according to the second embodiment of the invention.
Figure 6:
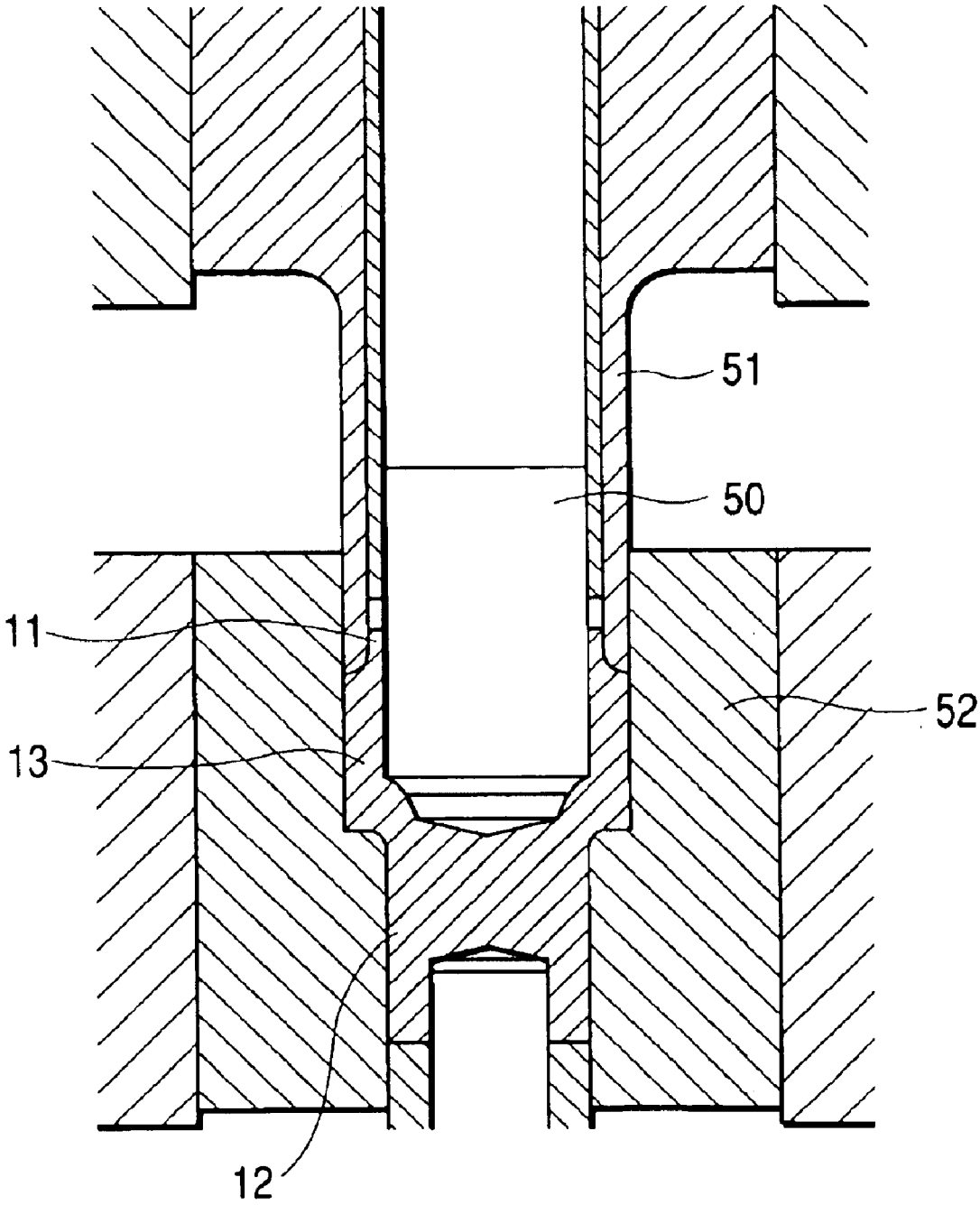
FIG. 6 PRIOR ART
FIG. 6 is a partially sectional view which shows a conventional forging process for making a spark plug shell.

FIGS. 5(*a*) to 5(*f*) illustrate a sequence of cold forging processes for making the metal shell 10 according to the second embodiment of the invention. The same reference numbers as employed in the first embodiment will refer to the same parts, and explanation thereof in detail will be omitted here.

First Process

First, a metal cylinder which is made of, for example, a low carbon steel and cut to a given length is placed in a first station (not shown) of a cold forging machine and swaged to form a first forged workpiece 210, as shown in FIG. 5(*a*), which is of cylindrical shape.

Second Process

The first forged workpiece 210 is placed in a second station (not shown) of the cold forging machine and swaged to form a second forged workpiece 220, as shown in FIG. 5(*b*), with a sloping shoulder which is substantially identical in shape with the first forged workpiece 110 in the first embodiment.

Thid Process

The second forged workpiece 220 is placed in a third station (not shown) of the cold forging machine and extrusion molded to form a third forged workpiece 230, as shown in FIG. 5(*c*), which is substantially identical in shape with the second forged workpiece 120 in the first embodiment.

Fourth Process

The third forged workpiece 230 is placed in a fourth station (not shown) of the cold forging machine and subjected to extrusion molding to form a fourth forged workpiece 240, as shown in FIG. 5(*d*). In the fourth process, only the large cylindrical head preform 121 is extrusion molded. Specifically, the outer wall of the large cylindrical head preform 121 is machined to form three parts: a tapered wall 131*a*, a hexagonal boss 15, and an annular projecting wall 131*c*. The fourth forged workpiece 240 is substantially identical in shape with the fourth forged workpiece 140 in the first embodiment.

The fourth process employs the same extrusion molding machine as the one shown in FIG. 4 except that the second bore 23*b* of the lower die 23 is of hexagonal shape for making the hexagonal boss 15.

The fifth and sixth processes are identical with those in the first embodiment, and explanation thereof in detail will be omitted here.

While the present invention has been disclosed in terms of the preferred embodiments in order to facilitate better understanding thereof, it should be appreciated that the invention can be embodied in various ways without departing from the principle of the invention. Therefore, the invention should be understood to include all possible embodiments and modifications to the shown embodiments which can be embodied without departing from the principle of the invention as set forth in the appended claims.

What is claimed is:

1. A fabrication method of a metal shell which is made up of a small-diameter portion, a large-diameter portion, and a wrapping portion that is to be wrapped by staking about a porcelain insulator of a spark plug to achieve installation of the metal shell on the spark plug, comprising the steps of:

preparing a cylindrical workpiece which has a given length with a first and a second end opposed to each other;

preparing a punch, a die, and a mandrel;

placing said workpiece in said die and pressing said workpiece with said punch from the second end of said workpiece while the workpiece is held by the mandrel to shape the wrapping portion of the metal shell on a side of the first end of said workpiece in a first cold forging process; and processing said first forged workpiece to shape the small-diameter portion of the metal shell on a side of the second end of said workpiece in a second cold forging process.

2. A fabrication method as set forth in claim 1, further comprising the step of forming threads on an outer peripheral wall of the small-diameter portion for installation of the spark plug.

3. A fabrication method as set forth in claim 1, further comprising the step of processing said workpiece to form a large-diameter portion on the side of the second end and a small-diameter portion on the side of the first end prior to the first cold forging process in which the wrapping portion is formed.

4. A fabrication method as set forth in claim 1, wherein in the first cold forging process, a portion of said workpiece on the side of the first end is pressed within said die stepwise to decrease, in sequence, the portion of said workpiece in outer diameter to shape the wrapping portion of the metal shell.

5. A fabrication method as set forth in claim 3, wherein a hexagonal boss is formed on the large-diameter portion of said workpiece in the first cold forging process.

6. A fabrication method as set forth in claim 3, wherein a hexagonal boss is formed on the large-diameter portion of said workpiece in a third process different from the first and second cold forging process.

* * * * *